United States Patent [19]

Masaki

[11] 4,404,941

[45] Sep. 20, 1983

[54] ELECTRONIC CONTROLLED CARBURETOR

[75] Inventor: Kenji Masaki, Yokohama, Japan

[73] Assignee: Nissan Motor Company Limited, Yokohama, Japan

[21] Appl. No.: 241,721

[22] Filed: Mar. 9, 1981

[30] Foreign Application Priority Data

Mar. 11, 1980 [JP] Japan ..... 55-30491

[51] Int. Cl.[3] ..... F02B 3/00

[52] U.S. Cl. ..... 123/339; 123/438

[58] Field of Search ..... 123/437, 438, 439, 440, 123/339, 179 G

[56] References Cited

U.S. PATENT DOCUMENTS

| | | | |
|---|---|---|---|
| 3,760,785 | 9/1973 | Harrison et al. | 123/339 |
| 4,050,428 | 9/1977 | Masaki | 123/438 |
| 4,103,657 | 8/1978 | Minami . | |
| 4,103,695 | 8/1978 | Aono . | |
| 4,106,464 | 8/1978 | Yamashita et al. | 123/437 |
| 4,138,979 | 2/1979 | Taplin . | |
| 4,186,697 | 2/1980 | Yasuda et al. | 123/179 G |
| 4,187,814 | 2/1980 | Phelan et al. | 123/438 |
| 4,224,908 | 9/1980 | Bier et al. | 123/440 |
| 4,237,833 | 12/1980 | Des Lauriers . | |
| 4,292,945 | 10/1981 | Kiesling | 123/438 |
| 4,311,126 | 1/1982 | Cowles | 123/438 |

FOREIGN PATENT DOCUMENTS

| | | | |
|---|---|---|---|
| 1234093 | 3/1961 | Fed. Rep. of Germany | 123/179 G |
| 2421854 | 12/1974 | Fed. Rep. of Germany | 41/179 G |
| 2535969 | 4/1976 | Fed. Rep. of Germany . | |
| 2550089 | 5/1976 | Fed. Rep. of Germany . | |

*Primary Examiner*—Parshotam S. Lall

*Attorney, Agent, or Firm*—Schwartz, Jeffery, Schwaab, Mack, Blumenthal & Koch

[57] ABSTRACT

An internal combustion engine carburetor is disclosed which includes an induction passage provided therein with venturi means and controlled by throttle valve means, a fuel bowl connected through a main solenoid valve to a main fuel passage for discharging fuel through a main nozzle opening into the venturi means, a fuel pump connected through an auxiliary solenoid valve to an auxiliary fuel passage into which an air bleed opens for discharging fuel through a sonic nozzle opening into the induction passage downstream of the throttle valve means, and fast-idle mechanism for forcing the throttle valve means to open to a predetermined angle from its closed position. A control circuit is provided for providing a control signal corrected based on the density of atmospheric air, which corresponds to the rate of air flow through the induction passage for controlling the main and auxiliary solenoid valves. The control circuit is adapted to drive the fast-idle mechanism at low engine temperatures.

9 Claims, 3 Drawing Figures

CONTROL CIRCUIT
L50
L36
L24
L62
L60
L64
L72
L74
10
10a
10b
12a
12b
14a
14b
16
18
20
22
22b
24
26a
28a
28b
30a
30b
32a
32b
34
36
38
40
42
44
46
50
52
54
56
58
60
62
64
66
68
70

ELECTRONIC CONTROLLED CARBURETOR

BACKGROUND OF THE INVENTION

1. Field of the Invention

The invention relates to an electronically controlled carburetor for use in an internal combustion engine.

2. Description of the Prior Art

In order to improve engine starting, acceleration and deceleration performance, carburetors have been equipped with an increasing number of devices such as idle controls, choke valves, fast-idle devices, unloaders, perfect explosion mechanism, acceleration pumps, decelerating devices, power mixture supply mechanisms, and the like, which result in a very complex and expensive carburetor structure.

The present invention provides a simple and inexpensive carburetor structure which will achieve improved engine starting, acceleration and deceleration performance.

SUMMARY OF THE INVENTION

The present invention provides a carburator for an internal combustion engine. The carburetor comprises an induction passage having therein a venturi means and is controlled by throttle valve means located downstream of the venturi means. A fuel bowl is connected through a main solenoid valve to a main fuel passage for discharging fuel through a main nozzle opening into the venturi means and a fuel pump is connected through an auxiliary solenoid valve to an auxiliary fuel passage into which an air bleed opens for discharging fuel through a sonic nozzle opening into the induction passage downstream of the throttle valve means. The carburetor also includes a fast-idle mechanism for forcing the throttle valve means to open to a predetermined angle from its closed position. A control means is provided for generating a control signal corrected based on the density of atmospheric air, which corresponds to the rate of air flow through the induction passage for controlling the main and auxiliary solenoid valves. The control circuit is adapted to drive the fast-idle mechanism at low engine temperatures.

In a preferred embodiment, the induction passage is divided downstream of the venturi means into first and second passages. The throttle valve means includes first and second throttle valves for controlling the first and second passages, respectively. The second throttle valve is associated with the first throttle valve to close before the first throttle valve reaches a predetermined open position and to thereafter open with opening of the first throttle valve.

Alternatively, the induction passage may be divided substantially over its length into first and second passages. In this case, the venturi means includes a first venturi cluster into which the main fuel nozzle opens, and a second venturi cluster into which a fuel nozzle opens. The fuel nozzle is connected through a fuel jet to the fuel bowl. The second throttle valve disposed in the second passage is adapted to close before the vacuum in the first passage upstream of the first throttle valve disposed in the first passage and to thereafter open upon an increase in the first passage vacuum.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENTS

Figures 1, 2:
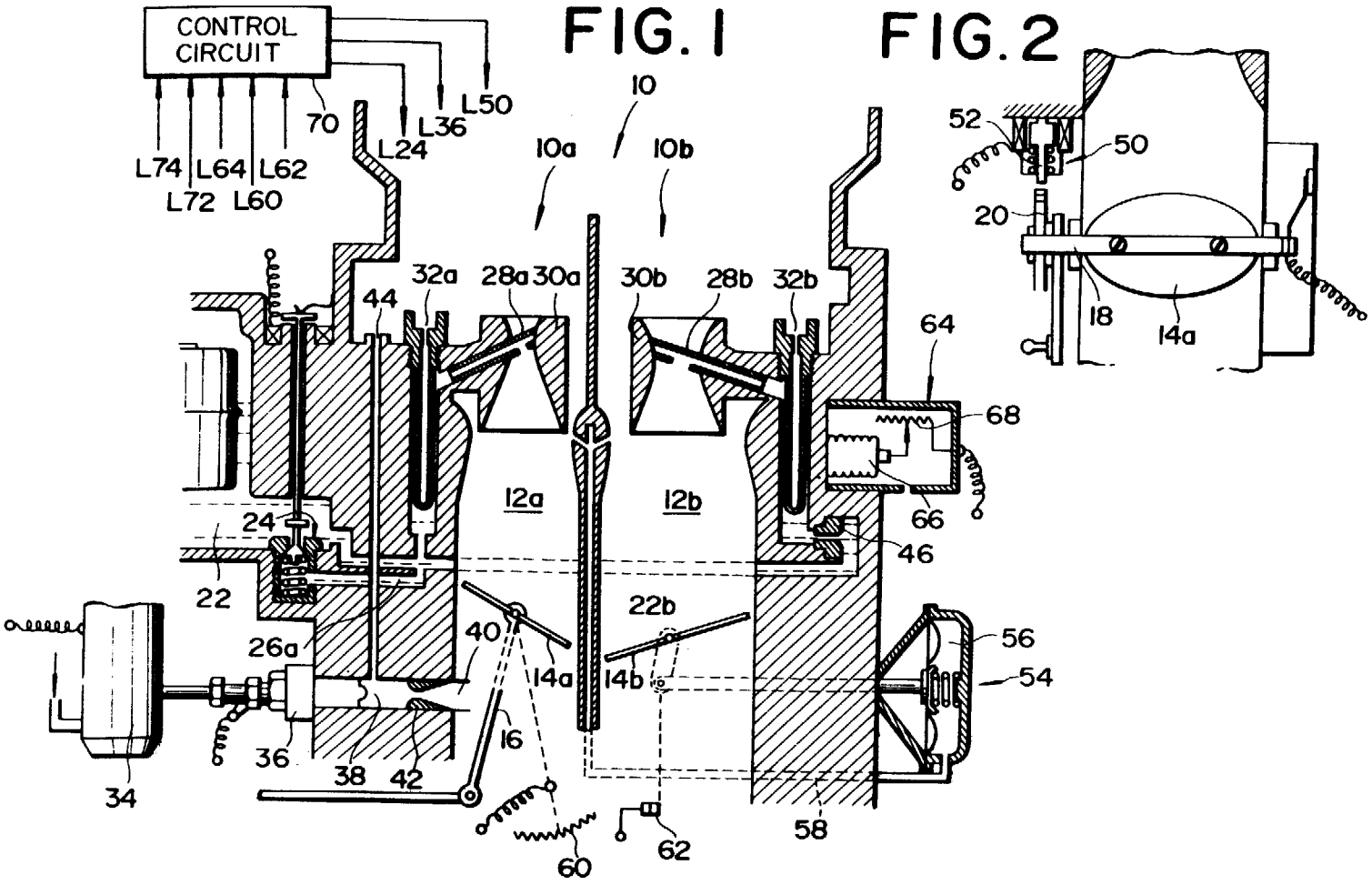
FIG. 1 is a sectional view showing one embodiment of an internal combustion engine carburetor made in accordance with the present invention.
FIG. 2 is a fragmentary sectional view showing a first-idle mechanism associated with a throttle valve of the carburetor of FIG. 1.

Referring first to FIG. 1, there is depicted an internal combustion engine carburetor unit 10 having primary and secondary carburetors 10*a* and 10*b*. The primary carburetor 10*a* has an air induction passage 12*a* controlled by a throttle valve 14*a* drivingly connected through a link mechanism 16 to an accelerator pedal (not shown). A fuel bowl 22 delivers fuel through a main solenoid valve 24 into a main fuel passage 26*a* which discharges through a main fuel nozzle 28*a* into a venturi cluster 30*a* disposed in the induction passage 12*a* under the vacuum developed in the venturi cluster 30*a* which is proportional to the rate of intake air flow through the induction passage 12*a*. A main air bleed 32*a* opens into the main fuel passage 26*a* for introducing air bubbles into the fuel flowing through the main fuel passage 26*a* to create a finely atmized air-fuel mixture. The rate of fuel flow through the main fuel passage 26*a* is determined by the operation of the main solenoid valve 24 which is controlled by a control circuit 70 in accordance with engine operating conditions. The control circuit 70 comprises a microcomputer.

An electric fuel pump 34 is provided for delivering fuel, at a relatively low pressure, through an auxiliary solenoid valve 36 into an auxiliary fuel passage 38. The auxiliary solenoid valve 36 is controlled by the control circuit 70. The auxiliary fuel passage 38 has a sonic nozzle 40 opening into the induction passage 12*a* downstream of the throttle valve 14*a* past a sonic orifice 42. An auxiliary air bleed 44 opens into the auxiliary fuel passage 38 between the auxiliary solenoid valve 36 and the sonic orifice 42.

The velocity of the air introduced from the auxiliary air bleed 44 into the auxiliary fuel passage 38 reaches that of sound when flowing through the sonic orifice 42 having a sufficiently small effective diameter. Thus, the rate of fuel flow through the sonic orifice 42 is held constant even though the throttle valve opening varies to change the suction vacuum developed at the sonic nozzle port. As a result, the pressure in the auxiliary fuel passage 38 upstream of the sonic orifice 42 is held at a constant value which is determined by the distance between the inlet port of the auxiliary air bleed 44 and the sonic orifice 42. Consequently, the pressure difference across the auxiliary solenoid valve 36 is dependent upon the pressure at the discharge side of the fuel pump 34 and is constant if the pressure at the discharge side of the fuel pump 34 is constant. Thus, it is possible to control the rate of fuel flow through the auxiliary fuel passage 38 regardless of the throttle valve opening position or engine operating conditions by controlling the degree of opening of the auxiliary solenoid valve 36.

Referring to FIG. 2, a fast-idle solenoid valve 50 is associated with the throttle valve 14*a* for forcing the throttle valve 14*a* to move to a predetermined open position from its closed position regardless of depression of the accelerator pedal. The fast-idle solenoid valve 50 has an operation rod 52 for abutment against a lever 20 secured to one end of the drive shaft 18 of the throttle valve 14*a*. When energized, the fast-idle solenoid valve 50 pushes the operation rod 52 to rotate the lever 20, causing the throttle valve 14*a* to rotate to a predetermined angle with respect to its closed position. As a result, the rate of air flow through the induction passage 12*a* increases. The control circuit 70 increases the degree of opening of the auxiliary solenoid valve 36 for an additional supply of fuel to the induction passage 12*a* to compensate for the increased intake air flow rate, thereby increasing the engine idling speed. The operation of the fast-idle solenoid valve 50 is controlled by the control circuit 70.

Referring back to FIG. 1, the secondary carburetor 10*b* has an air induction passage 12*b* separated from the induction passage 12*a* and controlled by a throttle valve 14*b*. Fuel is delivered from the fuel bowl 22 into a main fuel passage 26*b* which discharges through a main fuel nozzle 28*b* into a venturi cluster 30*b* disposed in the induction passage 12*b* under the vacuum developed in the venturi cluster 30*b* which is proportional to the rate of air flow through the induction passage 12*b*. A main air bleed 32*b* opens into the main fuel passage 26*b* for introducing air bubbles into the fuel flowing through the main fuel passage 26*b* to create a finely atomized air-fuel mixture. The main fuel passage 26*b* has therein a main fuel jet 46 located upstream of the main air bleed 32*b* for metering the fuel flow through the main fuel passage 26*b* to a constant rate.

The throttle valve 14*b* is drivingly associated to a spring returned, control vacuum actuated, diaphragm type servo mechanism 54. The servo mechanism 54 has its vacuum chamber 56 connected through a vacuum passage 58 to the throat of the induction passage 12*a* of the primary carburetor 10*a*. When the throttle valve 14*a* of the primary carburetor 10*a* moves to a relatively wide open position and the vacuum introduced into the vacuum chamber 56 of the servo mechanism 54 reaches a predetermined value, the throttle valve 14*b* of the secondary carburetor 10*b* starts to open. Thereafter, the throttle valve 14*b* opens with an increase in the vacuum developed in the induction passage 12*a* upstream of the throttle valve 14*a*. The degree of opening of the throttle valve 14*a* is sensed by a throttle position sensor 60. The closed or open position of the throttle valve 14*b* is sensed by a throttle switch 62.

An air density sensor 64 is provided for detecting the density of atmospheric air. The air density sensor 64 may be of the conventional type including a bellows 66 in which a standard gas is enclosed, and a potentiometer 68 adapted to provide a voltage corresponding to the displacement of the bellows 66.

Normally, the amount of fuel discharged from the main fuel nozzles 28*a* or 28*b* is substantially proportional to the rate of air flow through the associated induction passage. However, when the throttle valve 14*a* or 14*b* are in a narrow open position, the vacuum developed in the venturi cluster 30*a* or 30*b* is too small to suck fuel from the main fuel nozzle 28*a* or 28*b*. For this reason the carburetor unit of the present invention is designed to supply fuel mainly through the sonic nozzle 40 when the degree of opening of the throttle valves is relatively small and to supply fuel through the main fuel nozzles 28*a* and 28*b* when the degree of opening of the throttle valve is relatively large.

The operation of the carburetor unit constructed as described above in accordance with the present invention will now be described.

During engine starting and warming conditions, the control circuit 70 detects the conditions from a signal fed thereto through line L72 from an engine temperature sensor (not shown) and provides a drive signal through line L50 to the fast-idle solenoid valve 50 which thereby opens the throttle valve 14*a* to a predetermined open position so as to increase the rate of air flow through the induction passage 12*a*. Simultaneously, the control circuit 70 provides a control signal through line L36 to the auxiliary solenoid valve 36 which thereby opens wider than it opens under normal idling conditions. This increases the engine idling speed and achieve stable starting performance.

Under low load conditions after the engine is warmed up, the control circuit 70 deenergizes the fast-idle solenoid valve 50 and provides a control signal to the auxiliary solenoid valve 36 for controlling the degree of opening of the auxiliary solenoid valve 36 in accordance with intake air flow rate so as to create an air-fuel mixture of proper (usually stoichiometric) air/fuel ratio. The control circuit 70 derives the intake air flow rate from a signal fed thereto through line L60 from the throttle valve position sensor 60, throttle switch 62 and a signal fed thereto through line L74 from an engine speed sensor (not shown).

When the engine load increases to produce in the venturi clusters a sufficient vacuum to suck fuel through the main fuel nozzles 28*a* and 28*b*, the control circuit 70 detects such conditions from the outputs of the throttle valve position sensor 60 and the engine speed sensor. In this case, the control circuit 70 closes the auxiliary solenoid valve 36 and provides a control signal through line L24 to the main solenoid valve 24 for controlling the degree of opening of the main solenoid valve 24 such that the amount of fuel discharged from the main fuel nozzles 28*a* and 28*b* is proportional to the rate of intake air flow to provide an air-fuel mixture of optimum (usually stoichiometric) air/fuel ratio.

Under high load conditions or during acceleration, the control circuit 70 opens the auxiliary solenoid valve 36 to increase the amount of fuel supplied to the engine so as to create an overrich air-fuel mixture, thereby permitting the engine to provide sufficient output power and obtaining superior acceleration performance. During deceleration, the control circuit 70 closes the auxiliary solenoid valve 36 for minimizing fuel consumption.

In the case where an air/fuel ratio sensor is used for air/fuel ratio feedback control, accurate air/fuel control can be achieved by using on-off type solenoid valves for the main and auxiliary solenoid valves 24 and 36 and applying thereto a pulse signal having its pulse period held constant and its pulse width varied in proportion to the output of the air/fuel ratio sensor.

In order to compensate for mechanical variations introduced upon carburetor production and variations in atmospheric air density, the control circuit 70 corrects the degree of opening of the auxiliary solenoid valve 36 in accordance with a signal fed through line L64 from the air density sensor 64. This eliminates the undesirable influence of mechanical and air density variations on the air/fuel ratio control.

Figure 3:
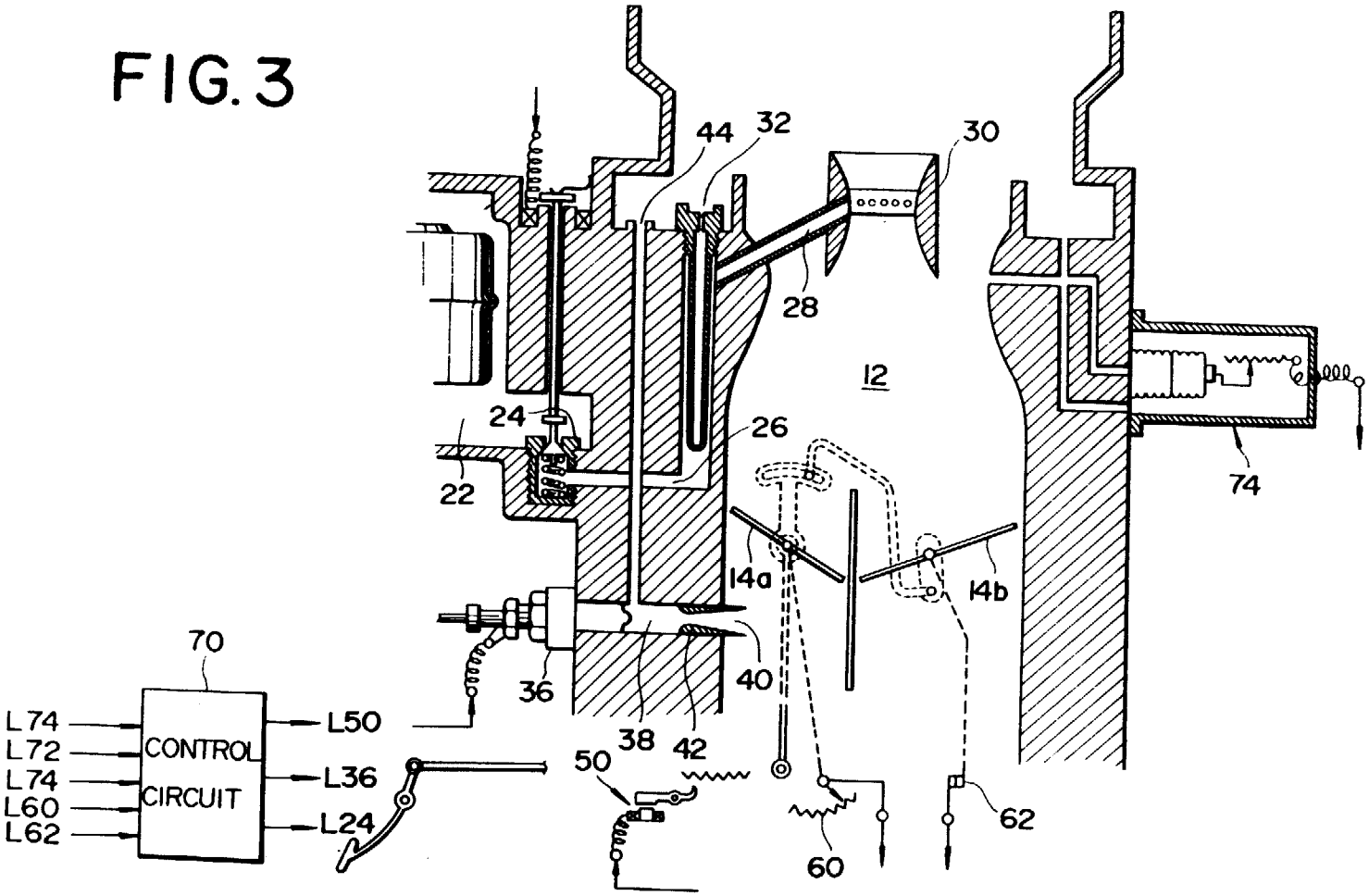
FIG. 3 is a sectional view showing an alternative embodiment of the present invention.

Referring to FIG. 3, there is illustrated an alternative embodiment of the present invention wherein like reference numerals indicate like parts as described with reference to FIG. 1.

In this embodiment, the carburetor unit 10 has a single venturi cluster 30 disposed in an air induction passage 12. The induction passage 12 has separated passages 12*a* and 12*b* downstream of the venturi cluster 30. The passages 12*a* and 12*b* has therein throttle valves 14*a* and 14*b* for controlling them, respectively. The throttle valve 14*b* is drivingly connected to the throttle valve 14*a* so as to remain closed until the first throttle valve reaches a predetermined open position and thereafter to open with the opening of the first throttle valve.

The fuel bowl 22 delivers fuel through a main solenoid valve 24 into a main fuel passage 26 which discharges through a main fuel nozzle 28 into the venturi cluster 30 under the vacuum developed in the venturi cluster 30. A main air bleed 32 opens into the main fuel passage 26 for introducing air bubbles into the fuel flowing through the main fuel passage 26.

The reference numeral 74 designates a bellows type pressure sensor for sensing the vacuum developed in the venturi portion of the induction passage 12. Under normal and high load conditions, the control circuit 70 detects the intake air flow rate from a signal fed thereto through line L74 from the pressure sensor 74 and controls the main and auxiliary solenoid valves 24 and 36 in accordance with the detected intake air flow rate.

The other structure and operation of the carburetor unit is substantially the same as described in connection with the first embodiment. This embodiment has several advantages over the first embodiment. First, it simplifies the venturi structure. Second, it eliminates the need for correction of the intake air flow rate measurement in accordance with exhaust gas recirculation ratio which is required in the first embodiment in case where exhaust gases are recirculated for $NO_x$ reduction. Third, it provides a more accurate intake air flow rate measurement as compared to the first embodiment where the intake air flow is inferred from the measurement of throttle valve position and engine rotating speed.

It is apparent from the foregoing that there has been provided, in accordance with the present invention, a simple and inexpensive carburetor which can assure high engine starting, acceleration and deceleration performance.

While the present invention has been described in connection with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A carburetor for use in an internal combustion engine, comprising:

(a) an induction passage provided therein with venturi means and controlled by throttle valve means located downstream of said venturi means;

(b) a main fuel supply unit including a fuel bowl, a main nozzle opening to said venturi means, and a main fuel passage connecting said fuel bowl to said main nozzle;

(c) an auxiliary fuel supply means including a fuel pump, an auxiliary fuel passage terminating in a sonic nozzle opening into said induction passage downstream of said throttle valve means, a solenoid valve provided in said auxiliary fuel passage for controlling the rate of fuel flow through said auxiliary fuel passage, an air bleed opening into said auxiliary fuel passage downstream of said solenoid valve;

(d) a fast-idle mechanism for forcing said throttle valve means to open to a predetermined angle from its closed position when actuated; and (e) a control circuit responsive to low engine temperatures for actuating said fast-idle mechanism and opening said solenoid valve to an opening degree coreresponding to said predetermined angle of opening of said throttle valve means, said control circuit being responsive to low load conditions for controlling the degree of opening of said solenoid valve in accordance with the rate of air flow through said induction passage, said control circuit being responsive to normal load conditions for closing said solenoid valve, said control circuit being responsive to high load conditions or a demand for acceleration for opening said solenoid valve to supply additional fuel so as to produce an overrich air-fuel mixture.

2. A carburetor according to claim 1, wherein said induction passage is divided downstream of said venturi means into first and second passages, and wherein said throttle valve means includes first and second throttle valves for controlling said first and second passages, respectively, said second throttle valve being operatively connected with said first throttle valve to remain closed until said first throttle valve reaches a predetermined open position and thereafter open with said first throttle valve.

3. A carburetor according to claim 2, wherein an air bleed opens into said main fuel passage.

4. A carburetor according to claim 2, wherein said control circuit is operable to determine a rate of air flow through said induction passage from a measurement of a vacuum developed in said induction passage.

5. A carburetor according to claim 2, wherein said venturi means includes a venturi cluster into which said main fuel nozzle opens.

6. A carburetor according to claim 1, wherein said induction passage is divided substantially over its length into first and second passages, wherein said throttle valve means includes first and second throttle valves for controlling said first and second passages, respectively, wherein said second throttle valve is vacuum actuated and adapted to remain closed until the vacuum in said first passage upstream of said throttle valve reaches a predetermined value and thereafter to open with an increase in the first passage vacuum, and wherein said venturi means includes a first venturi cluster into which said main fuel nozzle opens, and a second venturi cluster into which a second fuel nozzle opens, said second fuel nozzle being connected through a fuel jet to said fuel bowl.

7. A carburetor according to claim 6, wherein an air bleed opens into said main fuel passage.

8. A carburetor according to claim 6, wherein said control circuit is operable to determine the rate of air flow through said induction passage from a measurement of a first throttle valve opening position and engine rotating speed.

9. A carburetor according to claim 4 or 8, wherein said control circuit is operable to correct the determined air flow rate depending upon the density of atmospheric air.

* * * * *